US006015209A

United States Patent [19]

Barinaga et al.

[11] Patent Number: 6,015,209

[45] **Date of Patent: *Jan. 18, 2000**

[54] REPLACEABLE INK CONTAINER WITH FLUID INTERCONNECT FOR COUPLING TO AN INK-JET PRINTER

[75] Inventors: John A. Barinaga, Portland; James E. Clark, Albany; David O. Merrill, Corvallis, all of Oreg.; Ngoc-Diep Nguyen, Camas, Wash.; David R. Otis, Jr., Corvallis, Oreg.

[73] Assignee: Hewlett-Packard Company, Palo Alto, Calif.

[ * ] Notice: This patent is subject to a terminal disclaimer.

[21] Appl. No.: 09/053,556

[22] Filed: Apr. 1, 1998

Related U.S. Application Data

[63] Continuation-in-part of application No. 08/566,821, Dec. 4, 1995, Pat. No. 5,777,646, and a continuation-in-part of application No. 08/429,915, Apr. 27, 1995, Pat. No. 5,825,387.

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS

| | | |
|---|---|---|
| 743,798 | 11/1903 | Allwardt . |
| 1,304,814 | 5/1919 | Schweinert . |
| 1,638,488 | 8/1927 | Kellogg . |
| 1,850,879 | 3/1932 | Hunt . |
| 2,024,682 | 12/1935 | Eisenman . |
| 2,092,116 | 9/1937 | Hansen . |
| 2,434,167 | 1/1948 | Knoblauch . |
| 2,727,759 | 12/1955 | Elliott . |
| 2,888,173 | 5/1959 | Wolcott . |
| 2,915,325 | 12/1959 | Foster . |
| 2,925,103 | 2/1960 | Kerr . |
| 3,104,088 | 9/1963 | Cator . |
| 3,140,912 | 7/1964 | Davis . |
| 3,170,667 | 2/1965 | Szohatzky . |
| 3,230,964 | 1/1966 | Debrotnic . |
| 3,279,497 | 10/1966 | Norton . |
| 3,339,883 | 9/1967 | Drake . |
| 3,359,015 | 12/1967 | Zahuranec . |
| 3,490,473 | 1/1970 | Ehrens . |
| 3,537,477 | 11/1970 | Mahoff . |
| 3,614,940 | 10/1971 | Abrams et al. . |
| 3,640,309 | 2/1972 | Demler, Sr. . |
| 3,777,771 | 12/1973 | De Visscher . |
| 3,777,782 | 12/1973 | Shendure . |
| 3,825,222 | 7/1974 | Petrova . |
| 3,873,062 | 3/1975 | Johnson . |
| 3,896,853 | 7/1975 | Bernhard . |
| 3,924,654 | 12/1975 | Buller . |
| 4,053,901 | 10/1977 | Skafvenstedt . |
| 4,053,902 | 10/1977 | Skafvenstedt . |

(List continued on next page.)

*Primary Examiner*—N. Le
*Assistant Examiner*—Michael Nghiem
*Attorney, Agent, or Firm*—Kevin B. Sullivan

[57] ABSTRACT

One aspect of the present invention is a removable ink supply for forming a fluid connection with a fluid inlet of an ink-jet printer into which the ink supply can be installed. The ink-jet printer has a fluid conduit for supplying liquid ink to an ink-jet printhead. The removable ink supply includes a quantity of liquid ink and a fluid outlet. The fluid outlet includes (i) a hollow boss having a first end in fluid communication with the quantity of liquid ink, a neck formed in a second end of the boss, the neck defining a scaling surface and an opening; (ii) a sealing member positioned within the boss, the sealing member being movable between a first position in which the sealing member seals the opening and a second position in which liquid ink can flow through the boss opening; and (iii) a biasing structure for biasing the sealing member toward the first position. The ink supply is adapted for installation in the fluid inlet of the ink-jet printer. Upon installation the sealing member is engaged and displaced from the first position to the second position such that the sealing surface engages against a structure of the fluid inlet to create an ink seal.

17 Claims, 3 Drawing Sheets

U.S. PATENT DOCUMENTS

| | | | |
|---|---|---|---|
| 4,074,284 | 2/1978 | Dexter . | |
| 4,084,165 | 4/1978 | Skafvenstedt . | |
| 4,114,853 | 9/1978 | Medvick . | |
| 4,156,244 | 5/1979 | Erickson . | |
| 4,162,501 | 7/1979 | Mitchell et al. . | |
| 4,183,031 | 1/1980 | Kyser . | |
| 4,253,103 | 2/1981 | Heinzl . | |
| 4,303,929 | 12/1981 | Blanck . | |
| 4,324,239 | 4/1982 | Gordon . | |
| 4,345,627 | 8/1982 | Cassia . | |
| 4,371,004 | 2/1983 | Sysolin . | |
| 4,419,678 | 12/1983 | Kasugayama et al. . | |
| 4,421,296 | 12/1983 | Stephens . | |
| 4,429,320 | 1/1984 | Hattori . | |
| 4,475,116 | 10/1984 | Sicking . | |
| 4,496,959 | 1/1985 | Frerichs . | |
| 4,498,658 | 2/1985 | Mikiya . | |
| 4,506,276 | 3/1985 | Kyser et al. | 347/86 |
| 4,541,457 | 9/1985 | Blenkush . | |
| 4,591,875 | 5/1986 | McCann . | |
| 4,593,294 | 6/1986 | Parisi . | |
| 4,699,356 | 10/1987 | Hargrove . | |
| 4,700,744 | 10/1987 | Rutter . | |
| 4,709,725 | 12/1987 | Morrison . | |
| 4,737,801 | 4/1988 | Ichihashi . | |
| 4,739,847 | 4/1988 | Terasawa . | |
| 4,757,331 | 7/1988 | Mizusawa . | |
| 4,760,409 | 7/1988 | Kiyohara . | |
| 4,765,657 | 8/1988 | Cruse . | |
| 4,844,408 | 7/1989 | Beaston . | |
| 4,849,773 | 7/1989 | Owatari . | |
| 4,934,655 | 6/1990 | Blenkush . | |
| 4,991,820 | 2/1991 | Kohn . | |
| 5,002,254 | 3/1991 | Belisaire . | |
| 5,074,524 | 12/1991 | Wade . | |
| 5,126,767 | 6/1992 | Asai . | |
| 5,232,109 | 8/1993 | Tirrell et al. . | |
| 5,320,326 | 6/1994 | Ju . | |
| 5,390,702 | 2/1995 | Smith, III . | |
| 5,574,489 | 11/1996 | Cowger et al. | 347/86 |
| 5,777,646 | 7/1998 | Barinaga et al. | 347/86 |
| 5,825,387 | 10/1998 | Cowger et al. | 347/86 |

REPLACEABLE INK CONTAINER WITH FLUID INTERCONNECT FOR COUPLING TO AN INK-JET PRINTER

CROSS REFERENCE TO RELATED APPLICATIONS

This application is a continuation-in-part of U.S. patent application Ser. No. 08/566,821 filed Dec. 4, 1995, "Self-Sealing Fluid Interconnect with Double Sealing Septum", now U.S. Pat. No. 5,777,646, and a CIP of U.S. patent application Ser. No. 08/429,915 filed Apr. 27, 1995, "Ink Supply For An Ink-Jet Printer", now U.S. Pat. No. 5,825,387, both of which are assigned to the assignee of the present invention, the entire contents incorporated herein by reference.

BACKGROUND OF THE INVENTION

The present invention relates to an ink supply for an ink-jet printer and, more particularly to a self-sealing fluid interconnect for joining a replaceable ink supply to an ink-jet printer.

A typical ink-jet printer has a printhead mounted to a carriage that is moved back and forth over a print media, such as paper. As the printhead passes over appropriate locations on the printing surface, a control system selectively activates the printhead to eject, or jet, ink drops onto the print media to form images and text characters.

To work properly, such printers must have a reliable supply of ink for the printhead. One type of ink-jet printer makes use a disposable ink pen that can be mounted to the carriage. Such an ink pen typically includes, in addition to the printhead, a reservoir containing a supply of ink. The ink pen also typically includes pressure regulating mechanisms to maintain the ink supply at an appropriate pressure for use by the printhead. When the ink supply is exhausted, the ink pen is disposed of and a new ink pen is installed.

Other types of ink-jet printers make use of ink container portions that are separately replaceable from a printhead portion. For this type of printing system the printhead portion can include a pressure regulating mechanism to maintain proper operating pressure. The ink container portion may be mounted away from the carriage as disclosed in patent application Ser. No. 08/566,821 or mounted on the carriage. In either case it is crucial the replaceable ink container and printer be capable of establishing a reliable fluid connection therebetween. This fluid interconnection should be capable of repeated disconnects and reconnects as the ink container is removed and reinstalled. For the case of pressurized ink delivery systems the fluid interconnect should be robust enough to prevent leakage under normal operating pressures as well as under various environmental conditions the printer and ink containers are specified to experience either operating or non-operating.

SUMMARY OF THE INVENTION

One aspect of present invention is a removable ink supply for forming a fluid connection with an ink-jet printer into which the ink supply can be installed. The ink-jet printer has a fluid conduit for supplying liquid ink to an ink-jet printhead. The removable ink supply includes a quantity of liquid ink and a fluid outlet. The fluid outlet includes (i) a hollow boss having a first end in fluid communication with the quantity of liquid ink, a neck formed in a second end of the boss, the neck defining a sealing surface and an opening; (ii) a sealing member positioned within the boss, the sealing member being movable between a first position in which the sealing member seals the opening and a second position in which liquid ink can flow through the boss opening; and (iii) a biasing structure for biasing the sealing member toward the first position. The ink supply is adapted for installation in the fluid inlet of the ink-jet printer. Upon installation the sealing member is engaged and displaced from the first position to the second position.

Another aspect of the present invention is a fluid container for providing fluid to an ink-jet printer. The fluid container has a fluid outlet configured for connection to a fluid inlet associated with the ink-jet printer. The fluid outlet includes an engagement member sized sufficiently small to fit within a housing having a cylindrical opening therein. The housing encloses a hollow needle that has a distal and a proximal end. The housing also encloses a sliding sealing member that is movably mounted on the hollow needle to move between a closed position wherein an opening toward the distal end of the needle is occluded and an open position wherein the opening allows fluid flow through the opening into the hollow needle. The engagement member is configured to engage a sliding sealing member and move the sealing member from the closed to the open position. The fluid outlet also includes a fluid fitting portion that is configured for providing fluid through the opening in the hollow needle with the hollow needle in the open position.

DETAILED DESCRIPTION OF THE PREFERRED EMBODIMENT

Figure 1:
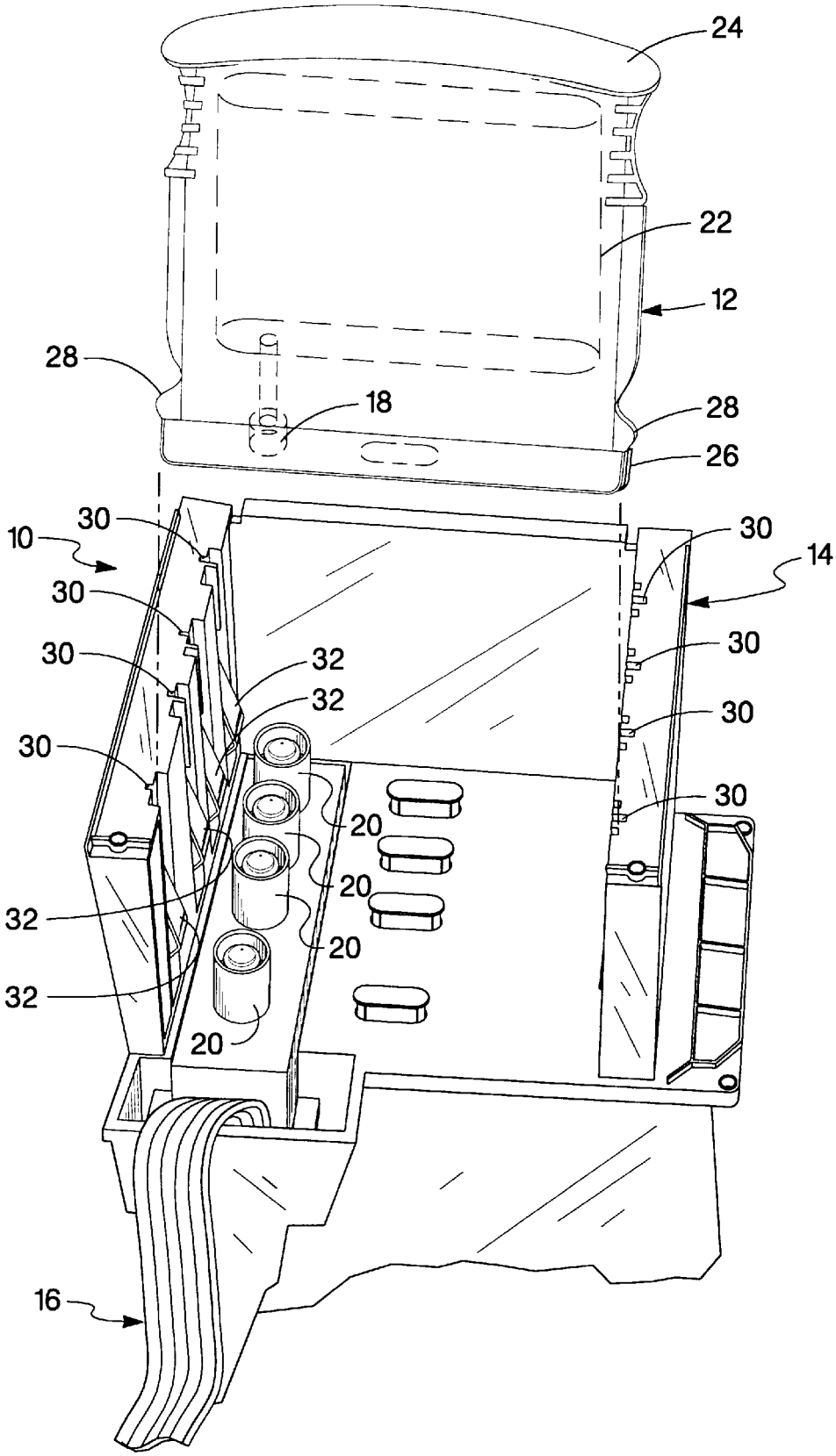
FIG. 1 depicts a perspective view of an ink container of the present invention positioned for insertion into a supply station portion of an ink-jet printer.

FIG. 1 depicts an ink-jet printing system 10 of the present invention. The ink-jet printing system 10 includes an ink container 12 positioned for insertion into an ink container receiving station 14. The ink container receiving station 14 is part of an ink-jet printer portion that includes one or more ink-jet printheads and a print controller. Printing is accomplished by the ejection of a marking fluid, such as ink, from the printhead under control of a print controller. The ink container 12 includes a fluid outlet 18 which is configured for connection to a fluid inlet 20 associated with the ink container receiving station to establish a reliable fluidic connection for providing ink from the ink container 12 to the printhead. Ink is provided to the inkjet printhead by way of one or more fluid conduits 16 that fluidically connect each of the printheads to each of the fluid inlets 20 associated with the ink container receiving station 14.

The ink container 12 includes an ink containment vessel 22 for containing a quantity of marking fluid such as ink. The ink containment vessel 22 is in fluid communication with the fluid outlet 18. Both the ink containment vessel 22 and the fluid outlet 18, in the preferred embodiment, are enclosed by a housing 24. In the preferred embodiment, the housing 24 includes keying and aligning features 26 and latching features 28. The keying and aligning features 26 associated with the ink container 12 work in conjunction with complimentary keying and aligning features 30 associated with the ink container receiving station 14. The keying and aligning features 26 and 30 provide an alignment function to ensure the fluid outlet 18 associated with the ink container 12 is properly aligned with the complimentary fluid inlet 20 associated with the ink container receiving station 14 during the insertion of the ink container 12 into the ink container receiving station 14. The keying and aligning features 26 and 30 also provide keying functions to ensure that the ink container 12 contains ink having the proper parameters such as proper ink color and ink compatibility Keying and aligning features are discussed in more detail in co-pending patent application Ser. No. 08/566,521 filed Dec. 4, 1995 entitled "Keying System For Ink Supply Containers", assigned to the assignee of the present invention, incorporated herein by reference.

Once the proper ink container 12 is aligned and inserted into the ink container receiving station 14, a latching feature 32 associated with the ink container receiving station 14 engages the corresponding latching feature 28 associated with the ink container 12 to secure the ink container 12 to the ink container receiving station 14. With the ink container 12 properly latched into the ink container receiving station 14 the fluid outlet 18 associated with the ink container 12 is properly positioned within the fluid inlet 20 associated with the ink container receiving station 14 to establish fluid communication between the ink containment vessel 22 and the printhead.

Figure 2:
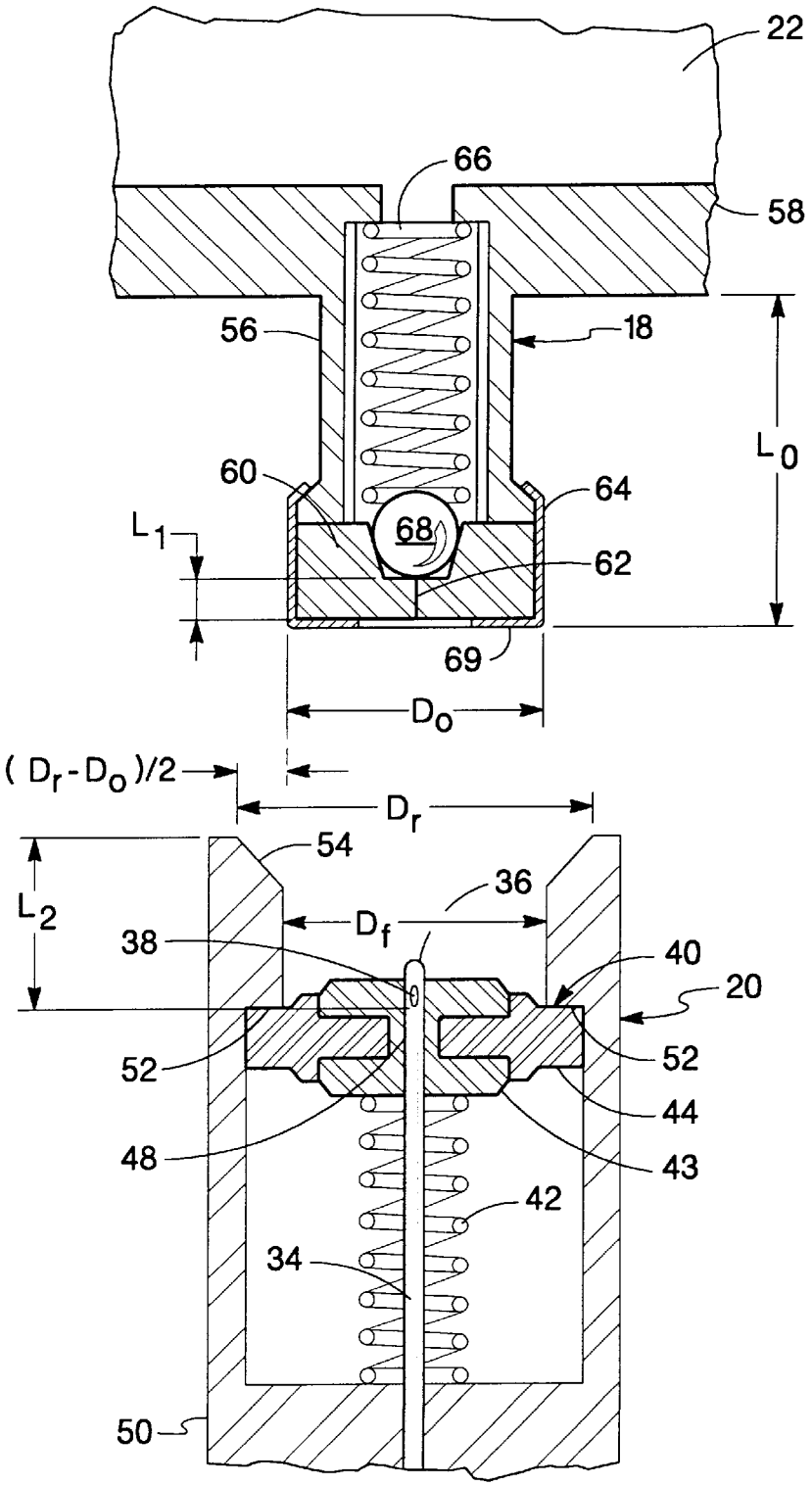
FIG. 2 depicts a fluid outlet associated with the ink container and a fluid inlet associated with the supply station, each shown greatly enlarged.

FIG. 2 depicts the fluid outlet 18 and the fluid inlet 20 shown in a greatly enlarged cross-section with the fluid outlet 18 positioned for insertion into the fluid inlet 20. The fluid inlet 20 associated with the ink container receiving station 14 includes an upwardly extending needle or stud 34 having a closed, blunt upper end 36 and a lateral hole 38 that extends into a blind bore. The blind bore extends axially through the needle 34. The fluid conduit 16 shown in FIG. 1 is in fluid communication with the blind bore thereby establishing fluid communication between the lateral hole 38 and fluid conduit 16.

A sliding collar 40 surrounds the upright needle 34 and is biased upward by a biasing means 42 such as a spring. The sliding collar 40 includes an inner compliant sealing portion 43 and an outer retaining portion 44. The compliant sealing portion 43 forms an inner ring about the needle 34 and has an exposed upper surface 46 and an inner surface 48 in direct contact with the upright needle 34. The retaining portion 44 of the sliding collar 40 is substantially rigid and forms an outer ring about the compliant sealing portion 43.

A housing 50 surrounds the upright needle 34, sliding collar 40 and biasing portion 42. The housing 50 is generally cylindrical and extends upward from the ink container receiving station 14. The housing 50 has a distal portion having an annular stop 52 to limit the travel of the sliding collar 40 and define an upper position of the sliding collar 40 on the needle 34. In the upper position, the lateral hole 38 is surrounded by the sealing portion 43 of the sliding collar 40 to seal the lateral hole. Also included at the distal end of the housing 50 is a tapered lead-in portion 54. The tapered lead-in portion provides guiding and centering as the fluid inlet 18 is received by the fluid outlet 20.

The fluid outlet 18 includes a hollow cylindrical boss 56 which extends downward from an ink container chassis 58. The hollow cylindrical boss 56 has a proximal end 57 proximate the chassis 58 and a distal end 59 spaced from the chassis 58. The proximal end 57 of the hollow cylindrical boss 56 opens into the ink containment vessel 22 thereby allowing ink to flow freely into the hollow cylindrical boss 56. At the distal end 59 of the hollow cylindrical boss is a septum 60 having a slit 62. The septum is secured to the distal end 59 of the hollow cylindrical boss 56 by a crimp cap 64. A spring 66 and a sealing ball 68 are positioned within the boss 56 and are held in place by the compliant septum 60 and a retaining surface 67 of the hollow cylindrical boss 56. The length of the spring 66 is such that the spring biases the sealing ball 68 against a sealing surface on the septum 60 to form a fluidic seal. In one preferred embodiment, the sealing surface is a raised annular rib 69 surrounding an opening to the slit 62 in septum 60. An additional seal is formed by the self-sealing slit 62 in the septum 60.

Figure 3:
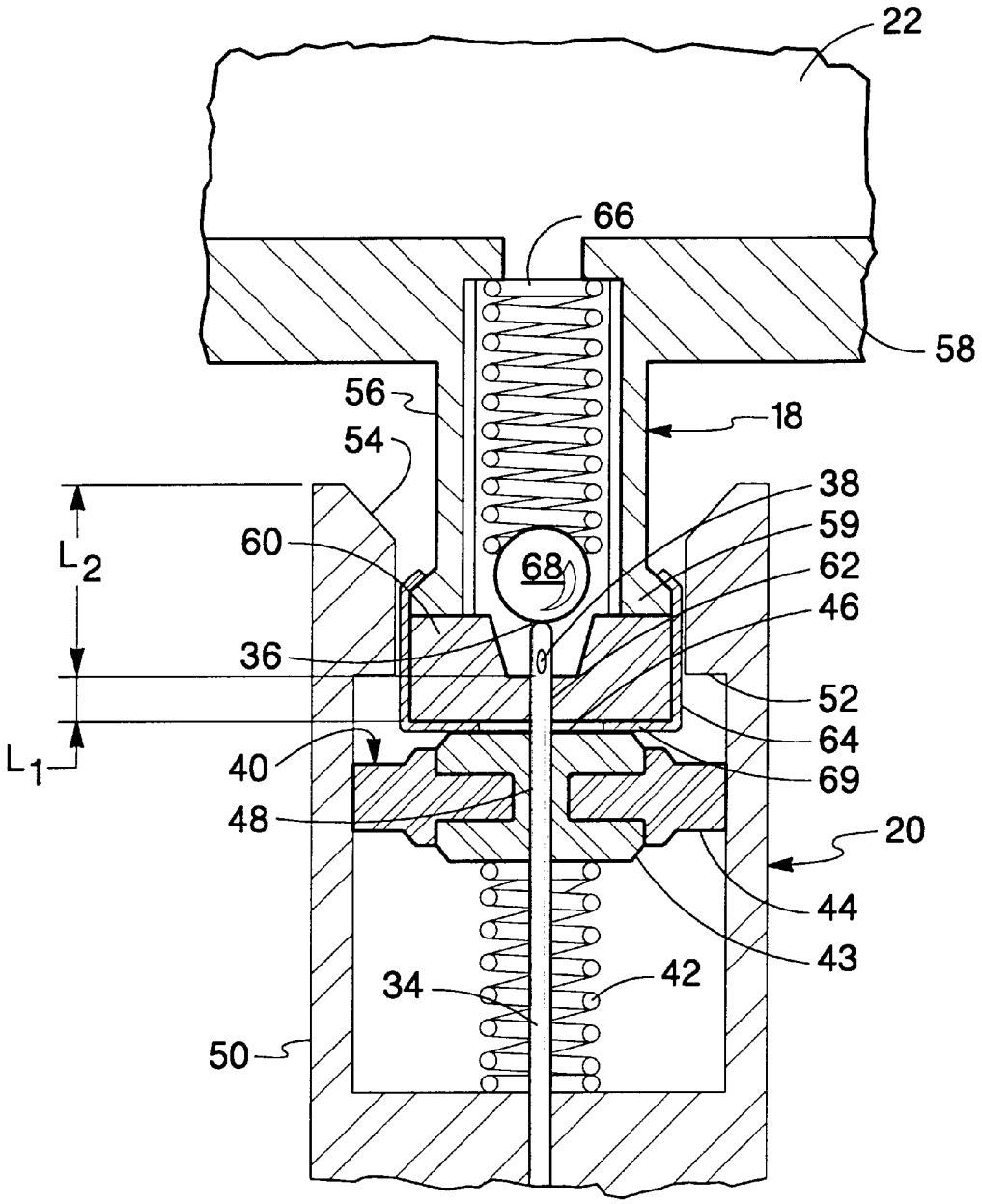
FIG. 3 depicts the fluid outlet disposed within the fluid inlet to establish a fluidic connection between the fluid inlet and outlet shown in FIG. 2.

FIG. 3 depicts the fluid outlet 18 positioned within the fluid inlet 20 to establish fluid communication between the ink container 12 and the ink container receiving station 14. Insertion of the ink container 12 into the ink receiving station 14 involves the alignment of the fluid outlet 18 with the fluid inlet 20. During insertion of the ink container 12 into the ink container receiving station 14 the guiding and aligning features 26 and 30 provide a coarse alignment of the fluid outlet 18 with the fluid inlet 20. This coarse alignment ensures that the leading edge or distal end of the fluid outlet 18 falls within a receiving diameter designated $D_r$ in FIG. 2. The receiving diameter $D_r$ represents a diameter defined by an outer extent of the tapered leading edge 54 of the housing 50. For a fluid outlet 18 having a distal end diameter represented by $D_o$ in FIG. 2 then the guiding and aligning features 26 and 30 should align the distal end of the fluid outlet 18 with the housing 50 to within a distance of $\pm(D_r-D_o)/2$ in order to ensure capture of the fluid outlet 18 within the housing 50 of the fluid inlet 20. If greater alignment tolerance is required, a taper or lead in can be provided on an outer annular radius of the distal end or leading edge of the fluid outlet 18. Once captured, the tapered leading edge 54 provides additional guiding and aligning to guide the distal end of the fluid outlet 18 into the housing 50.

Once the distal end of the fluid outlet 18 is captured by the housing 50 it is then important that the blunt upper end 36 of the needle 34 be properly aligned with the slit 62 in the septum 60. Because the septum 60 is compliant the needle 34 has some alignment tolerance. If the alignment tolerance between the needle 34 and the slit 62 is too great the needle may not be aligned with the septum 60 at all, or if aligned with the septum 60, the needle 34 may not be aligned with the slit 62, or if aligned with the slit the alignment tolerance may result in ink leakage between the needle 34 and the septum 60. To ensure that the needle 34 is properly aligned with the slit 62 in septum 60 the alignment tolerance as represented by the value of $(D_f-D_o)/2$ should be less than the required tolerance for aligning the needle 34 with the slit 62, where $D_f$ represents an inside fine alignment diameter for the housing 50 shown in FIG. 2.

The tapered leading edges 54 provides guiding and aligning function to ensure that the blunt end of the needle 36 properly engages the compliant septum 60 proximate the slit 62 so that a reliable fluid interconnect can be formed without requiring large insertion forces. It is important that the septum 60 have sufficient compliance to allow the insertion of the needle 36 forming a tight seal with the sides of needle 36 without requiring large insertion forces. At the same time, the septum 60 must seal sufficiently tight to prevent ink leakage from the fluid outlet 18 when the needle 36 is removed from the fluid inlet 20.

Once the fluid outlet 18 is aligned with the fluid inlet 20 further insertion of the fluid outlet 18 into the fluid inlet 20 produces the engagement of the distal end of the fluid outlet 18 with the upper surface 46 of the compliant sealing portion 43. Further insertion of the fluid outlet 18 urges the sliding collar 40 downward, compressing the spring 42. If the distal end of the fluid outlet is inserted sufficiently far the compliant portion 43 of the sliding collar is urged downward along the needle 34 toward the proximal end, away from the lateral hole 38, thereby unsealing the lateral hole 38.

As the distal end of the fluid outlet 18 is inserted into the housing 50 to urge the sliding collar 40 downward the blunt end 36 of needle 34 pierces through the slit 62 in the septum 60 and urges the sealing ball 68 upward compressing spring 66. If the distal end of the fluid outlet 18 is inserted sufficiently into the housing 50 the needle 34 extends through the septum 60 so that the lateral hole 38 opens into the cylindrical boss 56. The compliant septum 60 seals tightly around the needle 34 between the lateral hole 38 and the proximal end of the needle to form a fluid fitting thereby establishing fluid communication between the ink vessel 22 and the fluid conduit 16 shown in FIG. 1. In addition, the upper surface 46 of the inner compliant sealing portion 43 engages the distal end of the fluid outlet 18 to prevent leakage of any ink that escapes between the needle and the septum 60 along slit 62.

To establish a proper fluid communication with the fluid inlet 20 associated with the ink container receiving station 14 it is crucial that the fluid outlet 18 associated with the ink container 12 be sized small enough to fit within the inside fine alignment diameter represented by the value $D_f$ and large enough to provide proper alignment with the needle 34. In addition, it is crucial that the fluid outlet 18 associated with the ink container 12 have an engagement portion or cylindrical boss 56 that is of sufficient length represented by $L_o$ that is sufficiently large to extend into the housing 50 a distance the lateral hole 38 is recessed from the leading edge or distal end of the housing 50 as represented by the value $L_2$ in FIG. 2. The cylindrical boss 56 should be of sufficient length to engage the sliding collar 40 and move the sliding collar from a closed position wherein the compliant sealing member 43 occludes the lateral hole 38 to an open position wherein the compliant sealing member 43 is displaced from the lateral hole 38. For the case where the fluid fitting portion for establishing fluid communication with the lateral hole 38 in needle 34 is a septum 60 type fluid fitting then the length of the engagement portion or cylindrical boss 56 represented by the value $L_o$ should be a length that is at least $L_1+L_2$, where $L_1$ represents the thickness of the septum 60 measured at the slit 62 shown in FIG. 2. In this case the cylindrical boss is of sufficient length to ensure that the septum 60 is positioned between the lateral hole 38 and the proximal end of the needle 34 so that proper fluid connection is established between the fluid outlet 18 and the fluid inlet 20.

Although the present invention has been described with respect to the preferred embodiment where the ink container 12 is mounted off of the print carriage the present invention is suited for other printer configurations as well. For example, the ink container 12 may each be mounted on the printing carriage. For this configuration each of the printhead and the ink container are separately replaceable.

What is claimed is:

1. A removable ink supply for forming a fluid connection with an ink-jet printer into which the ink supply is removably installed, the ink-jet printer having a fluid inlet and a fluid conduit for supplying liquid ink to an ink-jet printhead, the removable ink supply comprising:

a quantity of liquid ink;

a fluid outlet comprising (i) a hollow boss having a first end in fluid communication with the quantity of liquid ink, and a second end forming a neck, the neck defining a sealing surface and an opening; (ii) a first sealing member positioned within the neck of the boss, the first sealing member defining a slit, the slit having a closed orientation wherein liquid ink is prevented from flowing through the slit and the opening and an open orientation wherein liquid ink flows through the slit and the opening; (iii) a second sealing member positioned within the boss, the second sealing member being movable between a first position in which the second sealing member prevents liquid ink from flowing to the slit, and a second position in which liquid ink flows to the slit; and (iv) a biasing structure for biasing the second sealing member toward the first position; and wherein the ink supply fluid outlet is removably connectable with the fluid inlet of the ink-jet printer, such that the first sealing member is engageable with the fluid inlet and displaced from the first orientation to the second orientation by the fluid inlet, the second sealing member is engageable with the fluid inlet and displaced from the first position to the second position by the fluid inlet, and the sealing surface is engageable against the fluid inlet to create an ink seal.

2. The removable ink supply of claim 1 wherein the biasing structure includes a spring.

3. The removable ink supply of claim 1 wherein the second sealing member is a spherical member.

4. The removable ink supply of claim 1 wherein the biasing structure has a first end and a second end and the hollow boss has a retaining surface, and wherein the biasing structure is positioned within the hollow boss with the first end of the biasing structure engaging the retaining surface of the boss and the second end of the biasing structure engaging the second sealing member.

5. The removable ink supply of claim 1 wherein the sealing surface is a raised annular rib surrounding the opening and extending from the neck.

6. A removable ink supply for forming a fluid connection with a fluid inlet of an ink-jet printer into which the ink supply is removably installed, the ink-jet printer having a fluid conduit coupled to the fluid inlet for supplying liquid ink to an ink-jet printhead, the fluid inlet including a stud having a base and a top, the stud defining a blind bore open at the base and closed at the top, the base of the stud being in fluid communication with the fluid conduit, the stud further defining a lateral hole intersecting the blind bore near the top, and a sealing collar encircling the stud, the sealing collar having a top surface and an inner surface in contact with the stud, the sealing collar being movable from a first position in which the inner surface seals the lateral hole and the top surface is adjacent the top of the stud to a second position in which the lateral hole is exposed, the removable ink supply comprising:

a quantity of liquid ink within the removable ink supply;

a fluid outlet engageable with the fluid inlet when the removable ink supply is inserted into the ink-jet printer, the fluid outlet comprising (i) a hollow boss having a first end in fluid communication with the quantity of liquid ink, and a second end forming a neck, the neck defining a sealing surface and an opening; (ii) a first sealing member positioned within the neck of the boss, the first sealing member defining a slit, the slit having a closed orientation wherein liquid ink is prevented from flowing through the slit and the opening and an open orientation wherein liquid ink flows through the slit and the opening; and (iii) a second sealing member positioned within the boss, the second sealing member being movable within the boss between a first position in which the second sealing member prevents liquid ink from flowing to the slit, and a second position in which liquid ink flows from the quantity of liquid ink to the slit; and wherein the ink supply is removably installable into the ink-jet printer, such that as the ink supply is partially inserted into the ink-jet printer the top surface of the sealing collar engages the sealing surface to form a seal between the fluid inlet and the fluid outlet, the seal leaving no substantial space between the fluid inlet and the fluid outlet, and wherein as the ink supply is further inserted into the ink-jet printer, the boss moves the sealing collar from the first position to the second position to expose the lateral hole and the stud enters the opening to displace the first sealing member from the first orientation to the second orientation and to move the second sealing member from the first position to the second position, to allow the flow of liquid ink through the opening and into the lateral hole.

7. The removable ink supply of claim 6, further comprising a biasing structure for biasing the second sealing member toward the first position.

8. The removable ink supply of claim 7 wherein the biasing structure includes a spring.

9. The removable ink supply of claim 7 wherein the biasing structure has a first end and a second end and the hollow boss has a retaining surface and wherein the biasing structure is positioned within the hollow boss with the first end of the biasing structure engaging the retaining surface of the boss and the second end of the biasing structure engaging the second sealing member.

10. The removable ink supply of claim 6 wherein the second sealing member is a spherical member.

11. The removable ink supply of claim 6 wherein the sealing surface is a raised annular rib surrounding the opening and extending from the neck.

12. A fluid container for providing fluid to an ink-jet printer including a fluid inlet having a housing, the fluid container having a fluid outlet configured for connection to the fluid inlet of the ink-jet printer, the fluid outlet comprising:

an engagement member extending from the fluid container, the engagement member being sized sufficiently small to fit within a cylindrical opening of the housing, the housing enclosing a hollow needle having distal and proximal ends and a sliding sealing member movably mounted on the hollow needle to move between a closed position wherein a needle opening toward the distal end of the needle is occluded and an open position wherein the needle opening allows fluid flow through the needle opening into the hollow needle, the engagement member configured to engage the sliding sealing member and move the sliding sealing member from the closed to the open position; and a fluid fitting portion coupled to the engagement member and configured for providing fluid through the needle opening in the hollow needle with the hollow needle in the open position, the fluid fitting portion including:

a fluid conduit;

a first sealing element disposed on the fluid conduit; and a second sealing element movably disposed within the fluid conduit, wherein with the hollow needle inserted into the fluid conduit, the hollow needle extends through the first sealing element and displaces the second sealing element.

13. The fluid container of claim 12 wherein with the hollow needle inserted into the fluid conduit, and with the hollow needle extending through the first sealing element and displacing the second sealing element, the first sealing element is positioned between the needle opening and the proximal end of the hollow needle such that the first sealing element forms a fluid seal between the fluid conduit and the hollow needle to allow fluid flow from the fluid container, past the second sealing element, and into the hollow needle.

14. The fluid container of claim 12 wherein the engagement member has a shape that is complementary to the cylindrical opening in the housing and the engagement member is sized sufficiently large that the engagement member interacts with the housing to guide the fluid fitting portion into alignment with the hollow needle.

15. The fluid container of claim 12 wherein the engagement member has an extension associated therewith that is sufficient to displace the sliding sealing member from the needle opening in the hollow needle when properly inserted into the housing.

16. The fluid container of claim 12 wherein the needle opening in the hollow needle is recessed a first distance from the cylindrical opening and wherein the engagement member extends a distance at least as great as the first distance to ensure the sliding sealing member is moved completely from the closed position to the open position upon insertion of the engagement member into the housing.

17. The fluid container of claim 12 further including a quantity of ink wherein ink is provided from the fluid fitting portion of the fluid container through the needle opening in the hollow needle associated with the ink-jet printer with the hollow needle in the open position.

* * * * *